United States Patent [19]

Luck

[11] Patent Number: 4,569,401

[45] Date of Patent: Feb. 11, 1986

[54] PORTABLE BOXING EXERCISER

[76] Inventor: Oliver W. Luck, P.O. Box 6243, San Diego, Calif. 92106

[21] Appl. No.: 570,877

[22] Filed: Jan. 16, 1984

[51] Int. Cl.[4] ..... A63B 23/00; A63B 69/00

[52] U.S. Cl. ..... 272/73; 272/78

[58] Field of Search ..... 272/76-78, 272/93, 73, 98, 134

[56] References Cited

U.S. PATENT DOCUMENTS

| | | | |
|---|---|---|---|
| 1,582,487 | 4/1926 | Shank | 272/78 |
| 1,744,594 | 1/1930 | Trzesniewski | 272/78 |
| 1,928,089 | 9/1933 | Blickman | 272/78 |
| 3,759,511 | 9/1973 | Zinkin et al. | 272/134 |
| 3,768,808 | 10/1973 | Passera | 272/96 |
| 4,084,812 | 4/1978 | Melrose et al. | 272/78 |
| 4,403,772 | 9/1983 | Stangle | 272/76 |
| 4,441,706 | 4/1984 | Korzaniewski | 272/76 |

FOREIGN PATENT DOCUMENTS

| | | | |
|---|---|---|---|
| 1018654 | 5/1983 | U.S.S.R. | 272/93 |

OTHER PUBLICATIONS

"Israel's Secret Sports Weapon"-The New York Times, 9-16-1973.

*Primary Examiner*—Richard J. Apley
*Assistant Examiner*—S. R. Crow
*Attorney, Agent, or Firm*—Charmasson & Holz

[57] ABSTRACT

A portable boxing exerciser which combines within a single frame a stationary bicycle and a punching ball positioned in front of the bicycle to allow the user to practice on the punching ball while riding the bicycle.

An adjustable chest rester is provided to help the user maintain his balance. The frame also supports a large punching bag and a set of barbells whose weight contribute to the stability of the entire structure.

5 Claims, 4 Drawing Figures

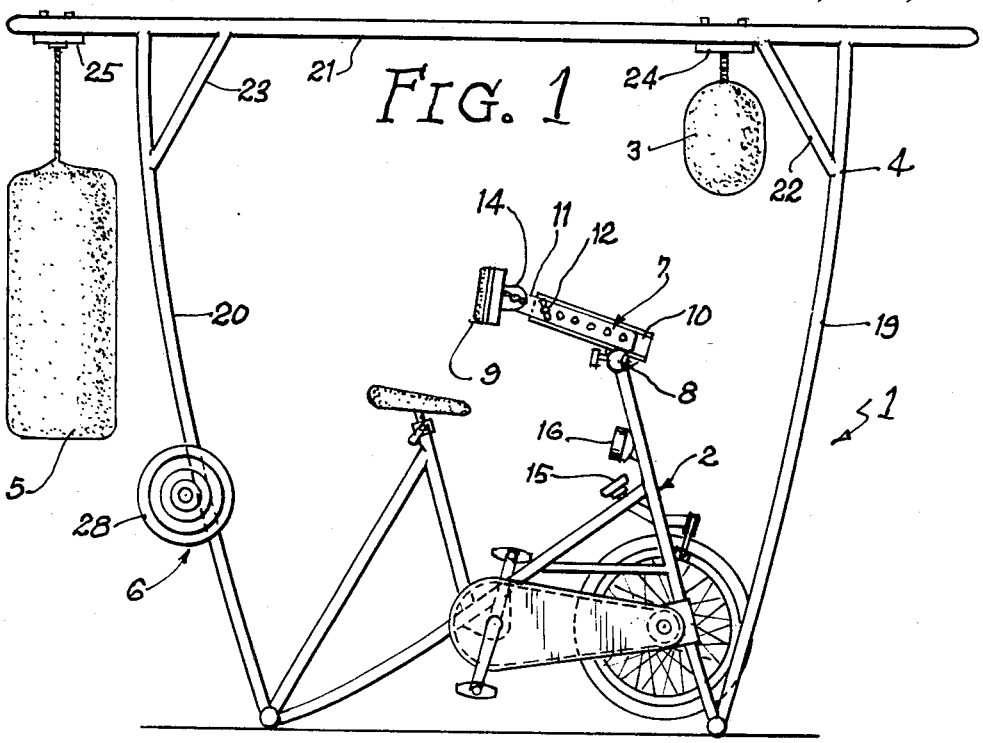
FIG. 1
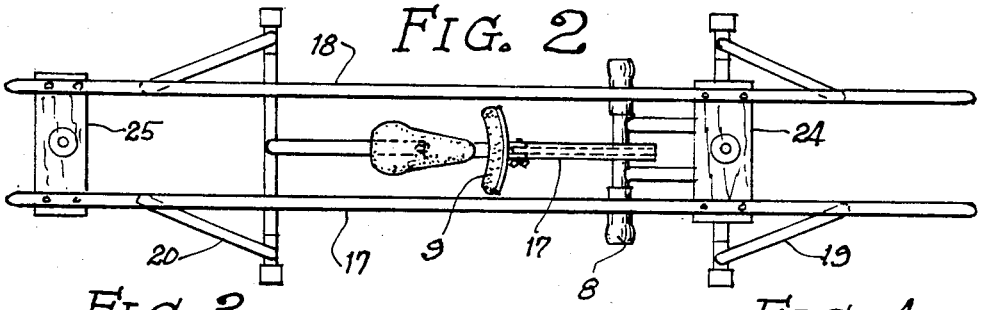
FIG. 2
FIG. 3
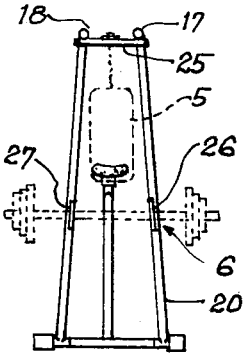
FIG. 4
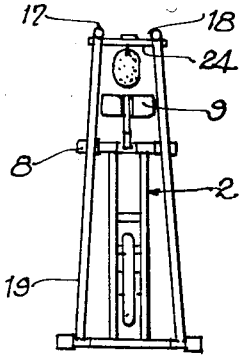

PORTABLE BOXING EXERCISER

FIELD OF THE INVENTION

The present invention relates to exercising machines for the training of athletes and for general health maintenance programs. More particularly, the invention relates to boxing exercises designed to teach balance and arm and leg coordination.

BACKGROUND OF THE INVENTION

Boxing requires arm and leg muscle power but also good speed, good balance and coordination. The athletes have traditionally used punching balls and punching bags, jump ropes and weights to acquire and maintain these necessary skills.

There is however, a need for a composite machine which could, at the same time, improve the user's strength, balance and coordination. It was discovered that the combination of an exercising bicycle with a punching ball station could yield such a multi-purpose device.

SUMMARY OF THE INVENTION

The principal object of this invention is to provide a boxing exerciser which, by simultaneously working the arms and legs of the user, can develop and maintain his muscular strength, his balance and his coordination.

Another object of this invention is to provide a boxing exerciser which can group in a single location the various implements commonly used by a training boxer.

A further object of this invention is to provide a boxing exerciser which is compact, easily movable and may be conveniently dismantled for storage.

These and other useful objects are achieved by a supporting frame containing an overhead adjustable punching bag in front of the stationary bicycle attached to said frame. The stationary bicycle has means for an adjustable chest rester to provide optimum support and angle so that the user may conveniently use the punching bag while bicycling on the stationary bicycle. The stationary bicycle has a speedometer and odometer for recording the stationary bicycle exercising and an adjustable brake to adjust pedaling resistance. Behind the person as seated on the bicycle, a angular support contains counterbalancing barbells and heavy punching bag for additional exercise stations.

BRIEF DESCRIPTION OF THE DRAWING

FIG. 1 is a side elevational view of the preferred embodiment of the BOXING EXERCISER;

FIG. 2 is a top plan view thereof;

FIG. 3 is a back elevational view thereof; and

FIG. 4 is a front elevational view thereof.

DESCRIPTION OF THE PREFERRED EMBODIMENT OF THE INVENTION

Referring now to the drawing, there is shown a composite boxing exerciser 1 which combines a stationary bicycle 2 with a punching ball station 3 within a single framework 4. A large punching bag 5 and a weight station 6 are also provided in the back section of the frame.

The exercising bicycle 2 follows the standard design of this type of device; but comprises, in addition, a chest rester 7 which extends from the top of the handle bar 8. The chest rester has a soft padded plate 9 against which the user of the exerciser can lean in order to maintain his balance while working both the bicycle and the punching ball 3. The chest rester 7 comprises an extensible arm formed by two telescopic elements 10 and 11 which can be adjusted to various length positions by means of a screw and wing nut combination 12 passing through matching holes drilled through the elements 10, 11. The chest rester is pivoted about an horizontal axis parallel and adjacent to the handle bar 8. A locking knob 13 is provided to lock the rotational adjustment of the telescopic elements. The position of the padded plate 9 can also be rotationally adjusted by releasing the screw and wing nut assembly 14 which secures it to the inner telescopic element 11. The stationary bicycle 2 is also provided with a brake 15 and an odometer 16. The framework 4 comprises two parallel trapezoidal elements 17, 18 extending from the forward and backward base of the bicycle exerciser 2. Each frame element 17, 18 comprises a front vertical support 19, a back vertical support 20 and a horizontal roof member 21. The structure is stabilized by two pairs of braces 22, 23. Crossplates 24 and 25 joining the two roof members 21 provide the attachment support for the punching ball 3 and the punching bag 5. Two brackets 26, 27 attached to the rear of the back vertical elements 20 provide a convenient way for supporting a set of barbells 28. The frame is preferably built from square tubing. The various elements are tied to one another by means of easily removable screw and wing nut assemblies. Accordingly, the entire device can be quickly dismantled for storage or transportation. The punching bag 5 and the barbell 28 are strategically positioned to provide stability for the entire structure.

While the preferred embodiment of the invention has been described, modifications can be made thereof and other embodiments can be devised without departing from the spirit of the invention and the scope of the appended claims.

What is claimed is:

1. An exercising device which comprises:

a stationary bicycle;

a base supporting said bicycle;

a punching ball;

means for maintaining said punching ball positioned with respect to said bicycle so that a user may work said punching ball while pedaling said bicycle; and a chest rest adjustably located to provide a leaning support for a user while pedaling said bicycle and working said ball;

wherein said means for maintaining comprises a tubular frame extending upwardly from said base and having two pairs of vertical elements respectively extending from the front and back of said base; and a pair of horizontal beams bridging the vertical elements; and wherein said punching ball is suspended from said horizontal beams.

2. The device claimed in claim 1 which further comprise a punching bag hanging from the rear portion of said horizontal beams.

3. The device claimed in claim 2 which further comprise means associated with one of said pair of vertical elements for supporting barbells.

4. The device claimed in claim 1 wherein said chest rest comprises:

an arm extending rearwardly from the center of the handle bar on said bicycle; and a padded plate adjustably attached to the rear end of said arm.

5. The device claimed in claim 4 wherein said chest rest further comprises means for adjusting the angular position of said arm about a horizontal axis.

* * * * *